US006073594A

United States Patent [19]

Tsukiana et al.

[11] Patent Number: 6,073,594

[45] Date of Patent: Jun. 13, 2000

[54] COOLING APPARATUS FOR CONSTRUCTION MACHINE

[75] Inventors: Takashi Tsukiana; Akihiko Eita; Kazuyuki Saki; Hiroaki Iwamitsu; Keiji Fujioka, all of Hiroshima, Japan

[73] Assignee: Kabushiki Kaisha Kobe Seiko Sho, Kobe, Japan

[21] Appl. No.: 09/130,520

[22] Filed: Aug. 7, 1998

[30] Foreign Application Priority Data

Aug. 8, 1997 [JP] Japan ..... 9-215288

[51] Int. Cl.[7] ..... F01P 11/08; F28F 9/00

[52] U.S. Cl. ..... 123/41.33; 123/41.55; 165/78; 165/140; 180/68.4

[58] Field of Search ..... 123/41.01, 41.33, 123/41.55, 196 R; 165/DIG. 306, DIG. 311, 916, 78, 76, 140; 180/68.4

[56] References Cited

U.S. PATENT DOCUMENTS

| | | | |
|---|---|---|---|
| 3,978,938 | 9/1976 | Joscher et al. | 180/68.4 |
| 4,403,648 | 9/1983 | Styok | 165/76 |
| 4,979,584 | 12/1990 | Charles | 180/68.1 |
| 5,046,554 | 9/1991 | Iwasaki et al. | 165/140 |
| 5,271,473 | 12/1993 | Ikeda et al. | 180/68.4 |
| 5,366,005 | 11/1994 | Kadle | 165/140 |
| 5,566,748 | 10/1996 | Christensen | 165/67 |
| 5,573,299 | 11/1996 | Masuda | 296/194 |
| 5,597,047 | 1/1997 | Thompson et al. | 180/68.4 |
| 5,671,803 | 9/1997 | Tepas et al. | 165/41 |
| 5,816,350 | 10/1998 | Akira et al. | 180/68.1 |
| 5,839,397 | 11/1998 | Funabashi et al. | 123/41.01 |

*Primary Examiner*—Noah P. Kamen
*Assistant Examiner*—Hai Huynh
*Attorney, Agent, or Firm*—Oblon, Spivak, McClelland, Maier & Neustadt, P.C.

[57] ABSTRACT

A construction machine having an oil cooler 3, a radiator 4, and a fan shroud 5 arranged in an upper rotating body 13, in which the oil cooler 3 and the fan shroud 5 are securely fixed to the upper rotating body 13 and the radiator 4 is adapted to be detachably fixed to the upper rotating body 13 while the oil cooler 3 and the fan shroud 5 are held in the state fixed to the upper rotating body 13.

11 Claims, 10 Drawing Sheets

COOLING APPARATUS FOR CONSTRUCTION MACHINE

BACKGROUND OF THE INVENTION

1. Field of the Invention

The present invention relates to a cooling apparatus for a construction machine adapted such that the radiator therein can be cleaned easily and completely.

2. Description of the Related Art

The engine cooling radiator installed in an upper rotating body of a construction machine in general gathers much dust on the radiator fins and, hence, it is required to carried out maintenance work to clean the radiator regularly.

Therefore, there was proposed such a design, a first prior art example, as shown in FIG. 9, in which an engine cooling radiator 41 is attached to the interior of an engine hood 40 and an oil cooler 42 to be disposed in front of the radiator 41 is supported by a hinge 43 on the side of the engine hood 40 so that the oil cooler 42 can be turned forward as indicated by the two-dot chain lines (refer to the gazette of Japanese Utility Model Laid-open No Hei 4-65920).

There was also proposed such a design, a second prior art example, as shown in FIG. 10, in which a dust protective net 44 is removably placed in guide grooves 41*a*, 41*a* provided on both sides of the front face of a radiator 41 (refer to the gazette of Japanese Utility Model Laid-open No. Sho 64-56531).

Further, there was proposed such a design, a third prior art example, as shown in FIG. 11, in which a radiator 41 and an oil cooler 42 are spaced apart a gap L and a top cover 46*a* and a side cover 46*b* are removably attached to the casing so as to cover the gap L (refer to the gazette of Japanese Utility Model Laid-open No. Sho 64-36523).

SUMMARY OF THE INVENTION

In the first prior art example shown in FIG. 9, in cleaning off the dust collected on the front face 41*a* of the radiator 41, the cleaning can be easily performed by turning the oil cooler 42 forward. However, when the front face 41*a* near the hinge 43 is to be cleaned, the oil cooler 42 is required to be greatly turned forward and, hence, a larger space S must be allowed for the forward turning. Further, since flexible pipes 45*a* and 45*b* for the inlet and outlet of the oil cooler 42 have to be greatly turned forward, a still larger space S allowing for their forward turning is required This prevents the vehicle from being designed to be smaller in size. Further, since a shroud (not shown) for fan 47 is provided on the side of the rear face 41*b* of the radiator 41, it is difficult to clean off the dust collected on the rear face 41*b* of the radiator 41.

In the second prior art example shown in FIG. 10, it is intended to prevent dust from collecting on the front face 41*a* of the radiator 41 by the use of the dust protective net 44. Since smaller dust particles pass through the meshes of the dust protective net 44 and attach to the front face 41*a* of the radiator 41, it must be regularly cleaned, but the cleaning is difficult because the space between it and the oil cooler is small.

In the third prior art example shown in FIG. 11, the dust attached to the front face 41*a* of the radiator 41 can be easily cleaned through the space L by removing the top plate 46*a* and the side plate 46*b*. However, since the space L is not large enough, the front face 41*a* of the radiator 41, especially the lower portion of the front face 41*a*, is difficult to clean. Further, since a fan shroud (not shown) is provided on the side of the rear face 41*b* of the radiator 41, it is difficult to clean off the dust collected on the rear face 41*b* of the radiator 41.

The present invention was made to solve the above described problems with the prior arts and it is an object of the invention to provide a cooling apparatus for a construction machine in which the radiator is adapted to be cleaned easily and completely.

To solve the above mentioned problems, the invention provides a cooling apparatus for a construction machine installed in an upper rotating body which comprises an oil cooler, a radiator, and a fan shroud, in which the oil cooler and the fan shroud are integrally connected and securely fixed to the upper rotating body, and the radiator is removably fixed to the upper rotating body through the integrally connected oil cooler and fan shroud.

According to the invention, the productivity is improved, since the oil cooler, the fan shroud, and the radiator can be assembled into a unit in advance and the assembly can be fixed in the upper rotating body at the time when the construction machine is fabricated. Further, since the radiator between the oil cooler and the fan shroud fixed in the upper rotating body is adapted to be fixed to and removed from the upper rotating body, only the radiator can be easily and quickly removed from and fixed to its position between the oil cooler and the fan shroud.

Further, construction may be made such that the oil cooler and the fan shroud are integrally connected by a frame member and such that the radiator can be placed into and taken out of the space surrounded by the oil cooler, the fan shroud, and the frame member and detachably fixed to the frame member.

Further, construction may be made such that a bonnet for opening and shutting is provided above an engine room of the construction machine, the oil cooler and the fan shroud are disposed in the vicinity of the engine, and the radiator is capable of being placed into and taken out of the space in the vertical direction.

Further, such construction is preferred that comprises ports projecting from the radiator for connection with cooling water supplying and draining pipes and the distance over which the oil cooler and the fan shroud confront is set so as to allow the ports for connection with cooling water supplying and draining pipes to be inserted between them.

Further, construction may be made such that the frame member is formed of a pair of left and right frame members and the oil cooler and the fan shroud have their left and right side end portions connected to the pair of left and right frame members so as to be fixed thereto.

Further, such construction is preferred that comprises a pair of left and right fixing seats provided at an upper portion of the frame members and a pair of left and right fixing portions provided at upper portions of the radiator, in which the fixing portions of the radiator are adapted to be suspended on the fixing seats on the frame members and detachably fixed to the same with fixing members.

Further, such construction is preferred that the radiator is detachably fixed to the frame member with fixing members from two directions, i.e., from the above and from the front, rear, left, or right.

BRIEF DESCRIPTION OF THE DRAWINGS

FIG. 8 is a side view of a cooling apparatus with the radiator removed by being lifted up by a crane or the like.

DESCRIPTION OF THE PREFERRED EMBODIMENT

An embodiment of the invention will be described in detail with reference to the accompanying drawings.

Figure 1:
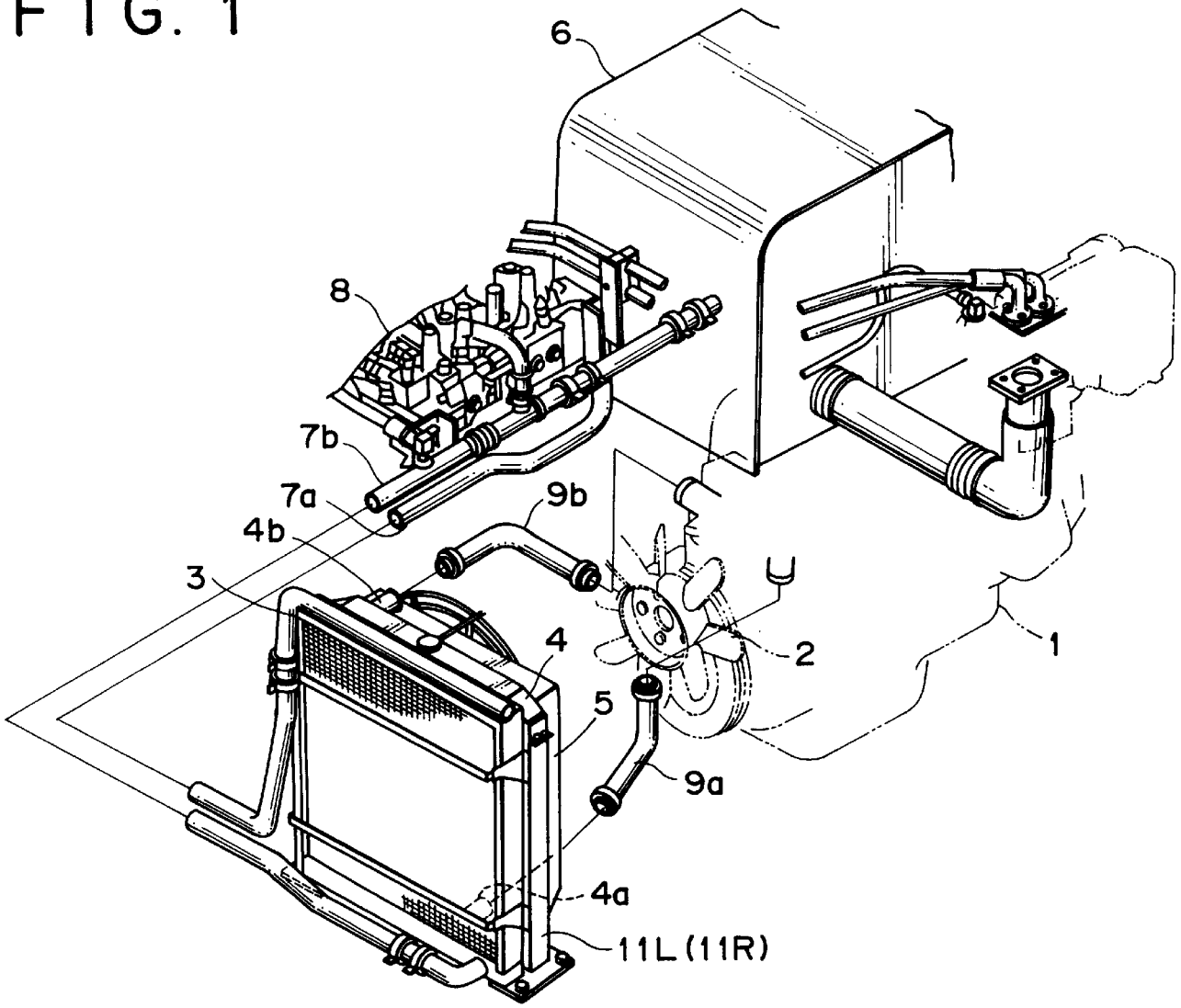
FIG. 1 is a perspective view of a cooling apparatus for a construction machine according to the invention.

As shown in FIG. 1, in the position in front of a cooling fan 2 of an engine 1 installed in an engine room of an upper rotating body 13 of a construction machine, there are disposed an oil cooler 3, a radiator 4, and a fan shroud 5 at predetermined intervals in the fore-and-aft direction. The oil cooler 3, the radiator 4, and the fan shroud 5 are each fixed to a pair of left and right frame members 11L and 11R as will be described later in detail.

Hydraulic oil pipes 7*a* and 7*b* are each fixed to the oil cooler 3. By having the return oil passed through the oil cooler 3 and returned to an operating oil tank 6, cooling is achieved. Reference numeral 8 denotes a hydraulic pressure control valve.

A lower port 4*a* and an upper port 4*b* of the radiator 4 are connected to cooling water pipes 9*a* and 9*b*, respectively, and by having the cooling water circulated to and from the engine 1, cooling is achieved.

Figure 5:
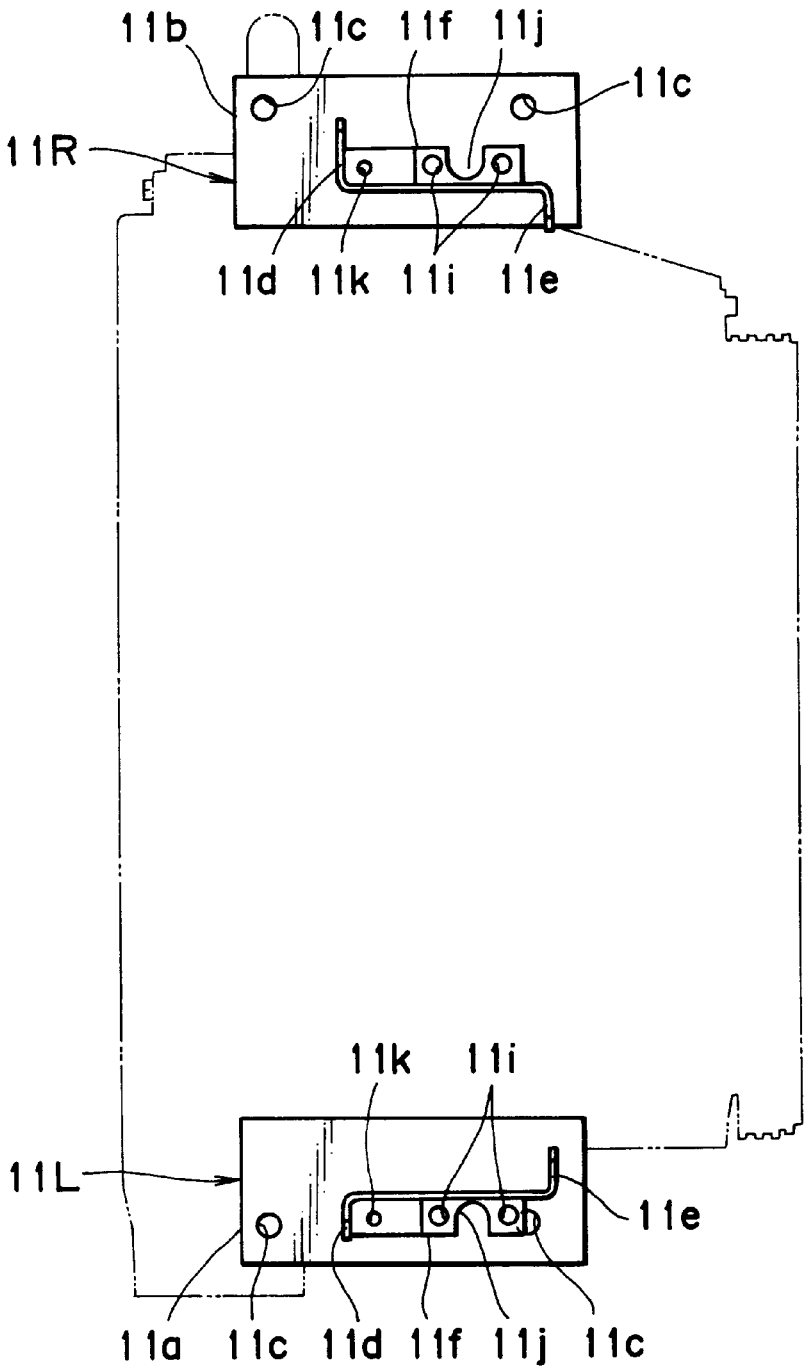
FIG. 5 is a plan view of frame members.
Figure 6:
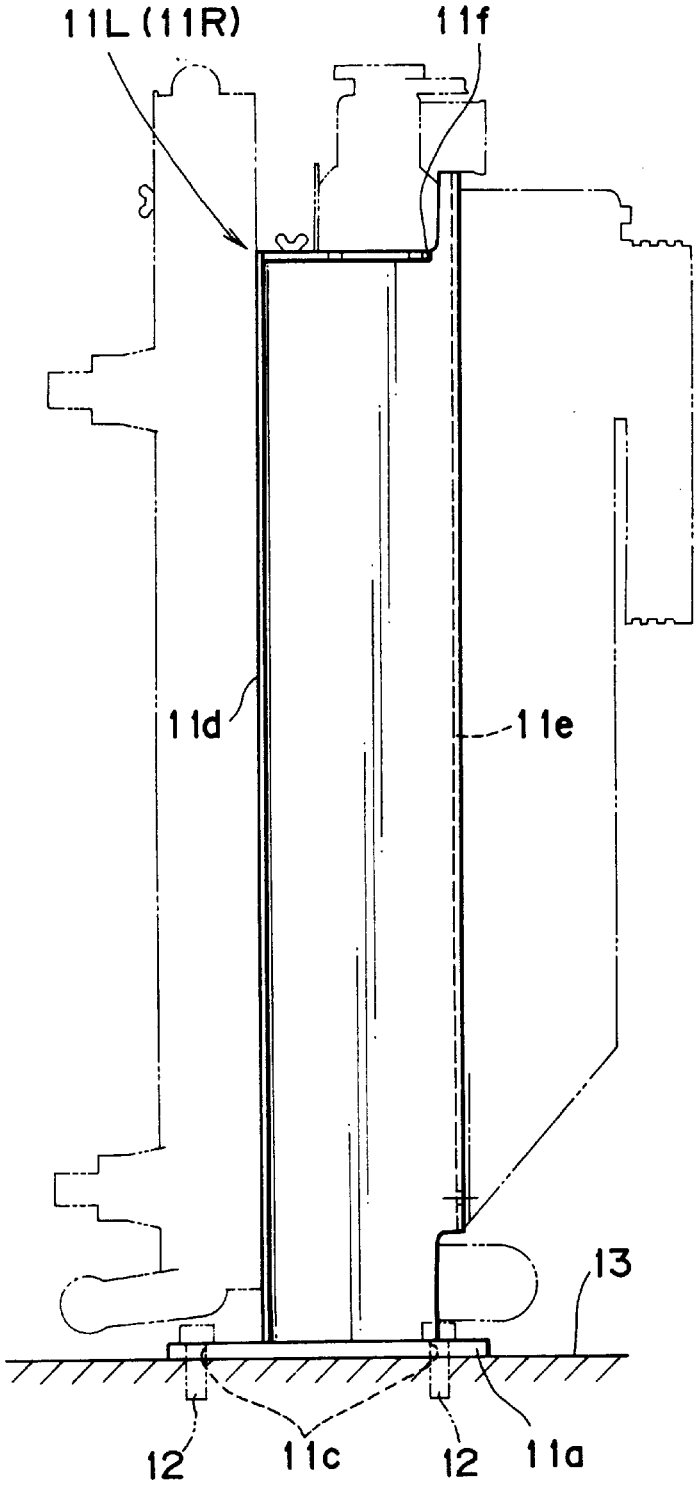
FIG. 6 is a side view of the frame members.
Figure 7:
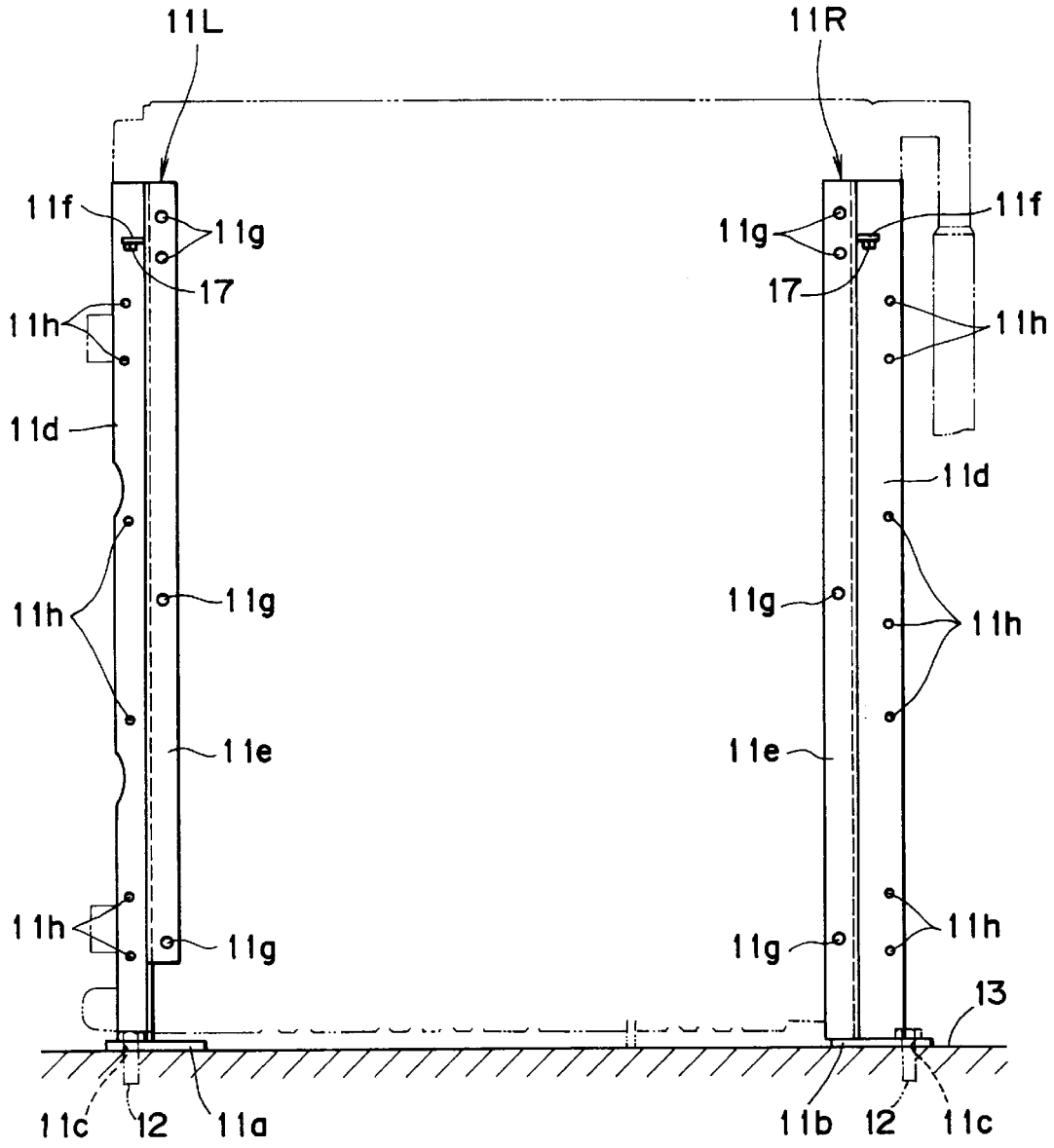
FIG. 7 is a rear view of the frame members.

As shown in detail in FIG. 5 to FIG. 7, the pair of the left and right frame members 11L and 11R are installed upright within the engine room of the upper rotating body 13 spaced apart a predetermined distance in the direction from left to right, by fixing their lower end plates 11*a* and 11*b* in the engine room of the upper rotating body 13 with bolts 12, . . . inserted through bolt holes 11*c*, . . .

Of the pair of the frame members 11L and 11R, the front end portions 11*d*, 11*d* are bent outward and the rear end portions 11*e*, 11*e* are bent inward as seen in their plan view (refer to FIG. 5). Their upper end portions are slightly recessed by being cut downward as seen in their rear view (refer to FIG. 7) and side view (refer to FIG. 6) and, on these upper end portions, there are provided fixing seats 11*f*, 11*f* so as to stick out.

Figure 4:
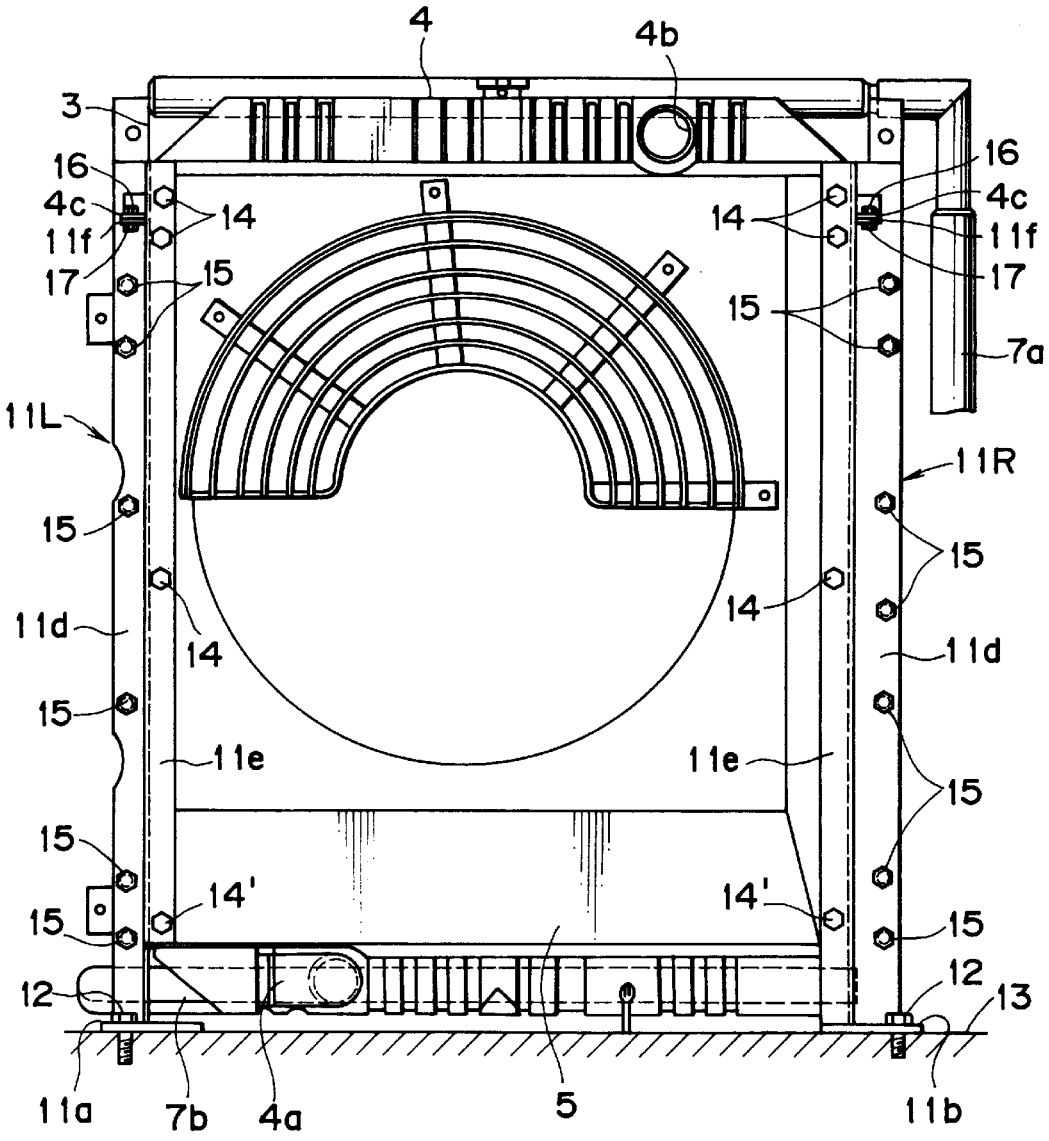
FIG. 4 is a rear view of the cooling apparatus.

In the left and right side end portions 11*e* on the rear side of the pair of the frame members 11L and 11R, there are bored pluralities of bolt holes 11*g*, . . . arranged in the vertical direction and, by using the bolt holes 11*g*, the left and right side end portions on the front side of the fan shroud 5 are fixed, as shown in FIG. 4, to their respective side end portions 11*e* with bolts 14, . . . The lowermost bolts 14' in the side end portions 11*e* are used also for fixing the lower portion of the radiator 4.

In the left and right side end portions 11*d* on the front side of the pair of the frame members 11L and 11R, there are bored pluralities of bolt holes 11*h*, . . . arranged in the vertical direction and, by using the bolt holes 11*h*, the left and right side end portions on the rear side of the oil cooler 3 are fixed to their respective side end portions 11*d* with bolts 15, . . .

In each of the fixing seats 11*f* provided on the pair of the frame members 11L and 11R, there are bored a pair of front and rear bolt screw holes 11*i*, 11*i* on the rear side. While there is formed a hook escaping recess 11*j* between the front and rear screw holes 11*i*, 11*i*, there is formed a bolt screw hole 11*k* on the front side.

Figure 2:
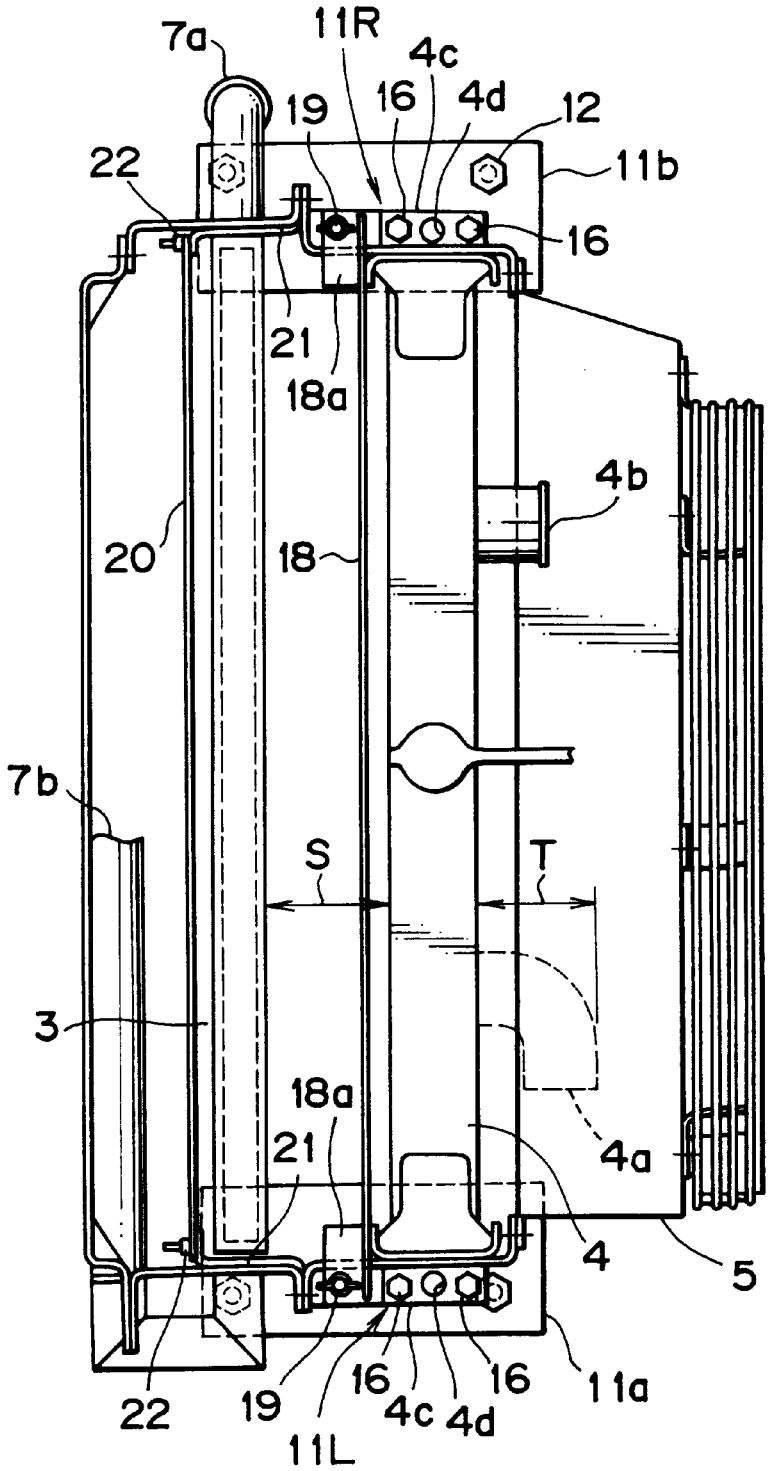
FIG. 2 is a plan view of the cooling apparatus.
Figure 3:
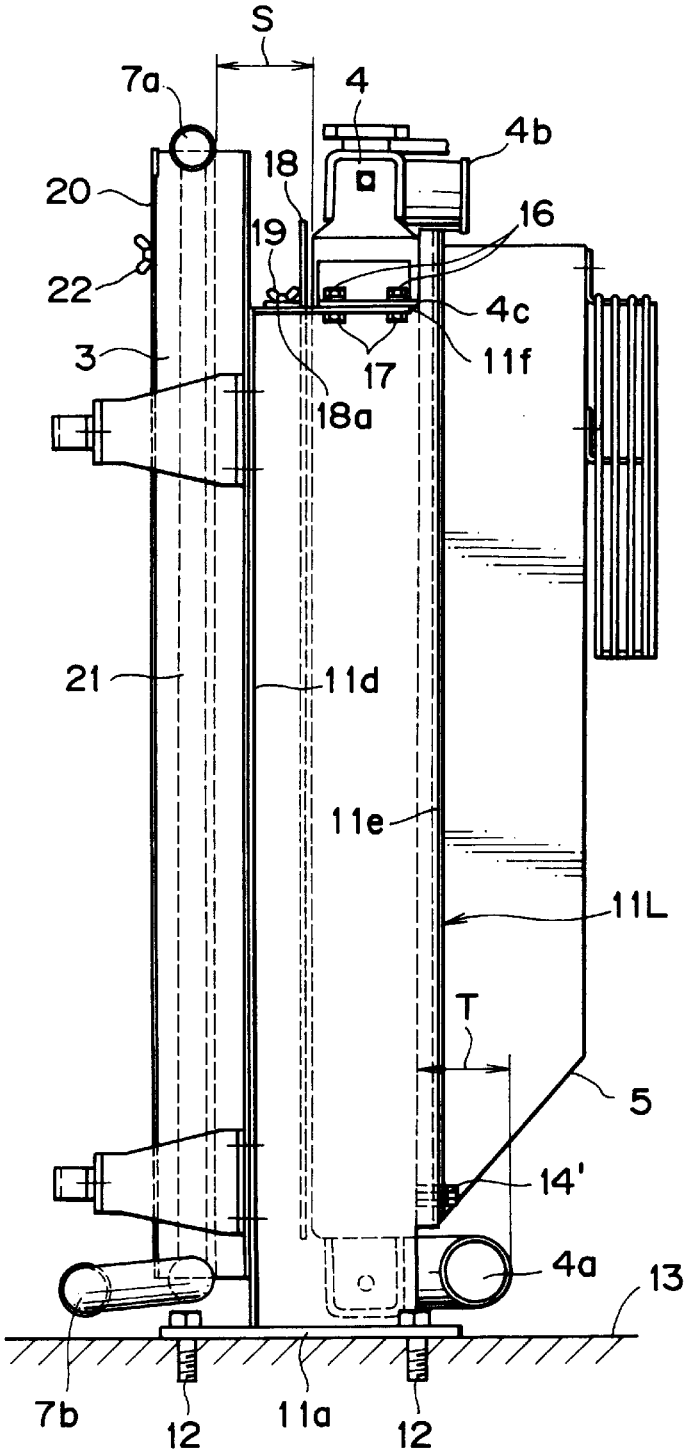
FIG. 3 is a side view of the cooling apparatus.

As shown in FIG. 2 to FIG. 4, the radiator 4 is provided, on both sides of its upper portion, with fixing portions 4*c*, 4*c* to be placed, from the above, on the rear portions of the fixing seats 11*f* on the pair of the frame members 11L and 11R. By means of the fixing portions 4*c*, the radiator 4 can be suspended on the fixing seats 11*f* for movement forward and backward.

In each of the fixing portions 4*c*, there are bored bolt holes (not shown in particular) agreeing with the pair of the bolt screw holes 11*i*, 11*i* in the corresponding fixing seat 11*f* and, by using the bolt holes and the bolt screw holes 11*i*, each fixing portion 4*c* is fixed, from the above, onto each fixing seat 11*f* with bolts 16 as fixing members. Reference numeral 17 denotes a weld nut for prolonging the bolt screw hole 11*i* in the fixing seat 11*f*. Between the bolt holes in each of the fixing portions 4*c*, there is formed a hole portion 4*d* for engagement with a hook.

Since the upper port 4*b* of the radiator 4 is projecting over the fan shroud 5, the radiator 4 interferes with nothing when it is removed to the above or fixed from the above. However, since the lower port 4*a* is projecting under the fan shroud 5 an amount of projection T, the radiator 4 interferes with the fan shroud 5 when it is removed to the above or fixed from the above.

Therefore, the distance over which the oil cooler 3 and the fan shroud 5 confront is so set that, when the radiator 4 is shifted (slid) forward a stroke S while each of the fixing portions 4*c* of the radiator 4 is placed on each of the fixing seats 11*f* on the pair of the frame members 11L and 11R, as shown in FIG. 2 and FIG. 3, the lower port 4*a* may be moved forward from under the fan shroud 5 and it, together with the radiator 4, may be moved in the vertical direction.

On the front side of the radiator 4, there is disposed a dust protective net 18. The dust protective net 18 has flange portions 18*a*, 18*a* on both sides of its upper portion. The flange portions 18*a*, 18*a* are each placed, from the above, on the front portion of each fixing seat 11*f* and fixed to it from the above by screwing a thumbscrew bolt 19 into each bolt screw hole 11*k*.

There is also disposed a dust protective net 20 in front of the oil cooler 3. There are provided brackets 21, 21 fixed to the front end portions 11*d* of the fixing seats 11*f* by bolts and nuts, or the like, and extended forward along both sides of the oil cooler 3. The dust protective net 20 is fixed to the brackets 21, 21, from the front, with thumbscrew bolts 22 screwed in the bolt screw holes (not shown in particular) formed above in the front end portion of the brackets 21, 21.

Procedures for installing and removing the radiator 4 structured as above will be described below.

There are fixed the pair of the left and right frame members 11L and 11R onto the vehicle 13 with bolts 12. The oil cooler 3 is fixed with bolts 15 to the front end portions 11*d* of the frame members 11L and 11R and the fan shroud 5 is fixed with bolts 14 to the rear end portions 11*e* of the same. Further, the dust protective net 20 for the oil cooler 3 is fixed to the front end portion of the brackets 21 with the thumbscrew bolts 22.

The radiator 4 is inserted from the above between the pair of the frame members 11L and 11R, their fixing portions 4*c* are placed on the rear portions of their respective fixing seats 11*f*, and fixed to them with bolts 16. The dust protective net 18 on the side of the front face of the radiator 4 is fixed to the front portions of the fixing seats 11*f* with the thumbscrew bolts 19. The lower port 4*a* and the upper port 4*b* of the radiator 4 are connected with the cooling water supplying pipes 9*a* and 9*b*, respectively.

In removing the radiator 4 in the described state from the position between the oil cooler 3 and the fan shroud 5, first the cooling water is drained from the radiator 4 and others and then the cooling water supplying pipes 9*a* and 9*b* are disconnected from the ports 4*a* and 4*b*.

Then, the dust protective net 18 on the side of the front face of the radiator 4 is extracted upward after loosening the thumbscrew bolts 19 and, thereafter, the bolts fixing the fixing portions 4*c* of the radiator 4 to the fixing seats 11*f* on the frame members 11L and 11R are unscrewed and removed. At this time, the radiator 4 is in, the state with its fixing portions 4*c* held placed on the fixing seats 11*f*. Since it is thus suspended on the frame members 11L and 11R, it is prevented from falling down accidentally. Then, by shifting (sliding) the radiator 4 forward a stroke S, the lower port 4*a* can be moved forward from under the fan shroud 5.

Figure 8:
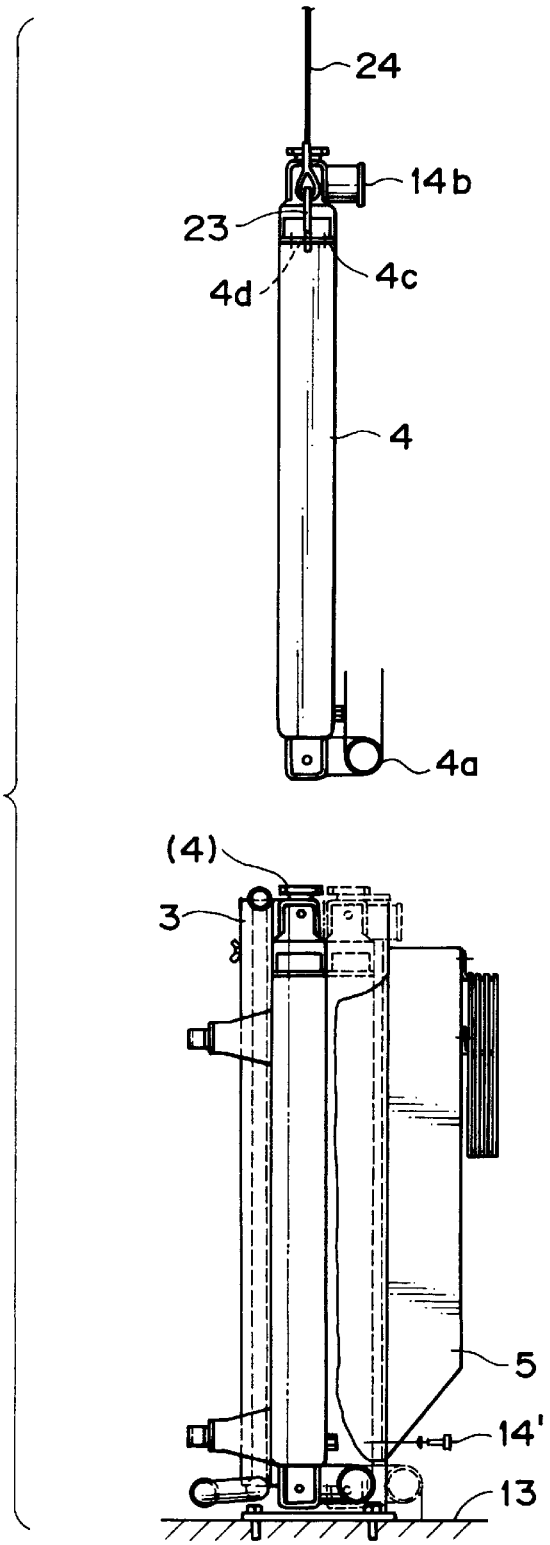
Figure 9:
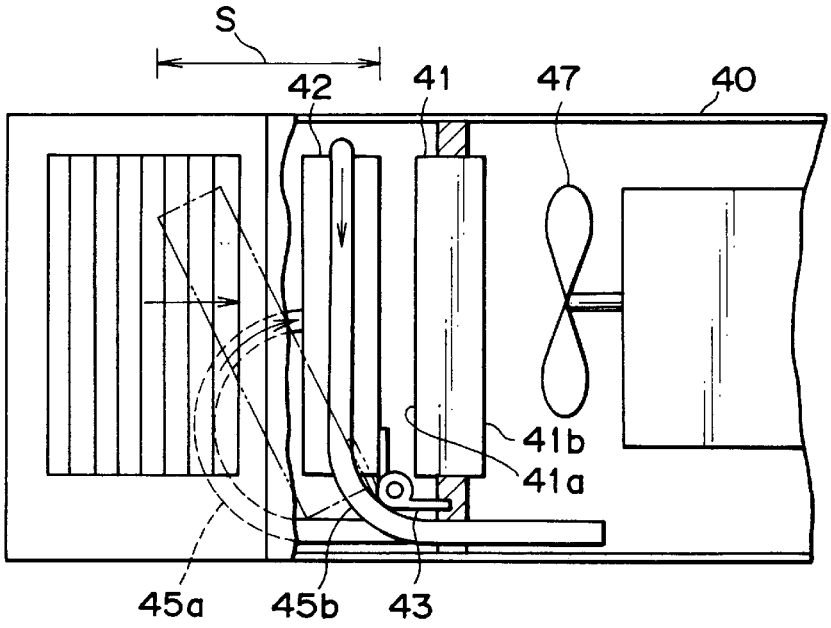
FIG. 9 is a side view of a cooling apparatus of a first prior art example.
Figure 10:
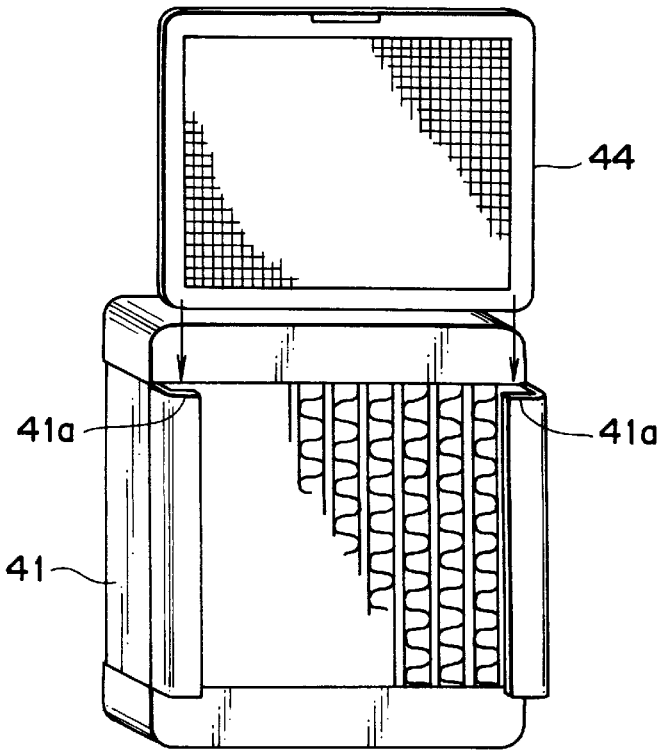
FIG. 10 is a perspective view of a cooling apparatus of a second prior art example.
Figure 11:
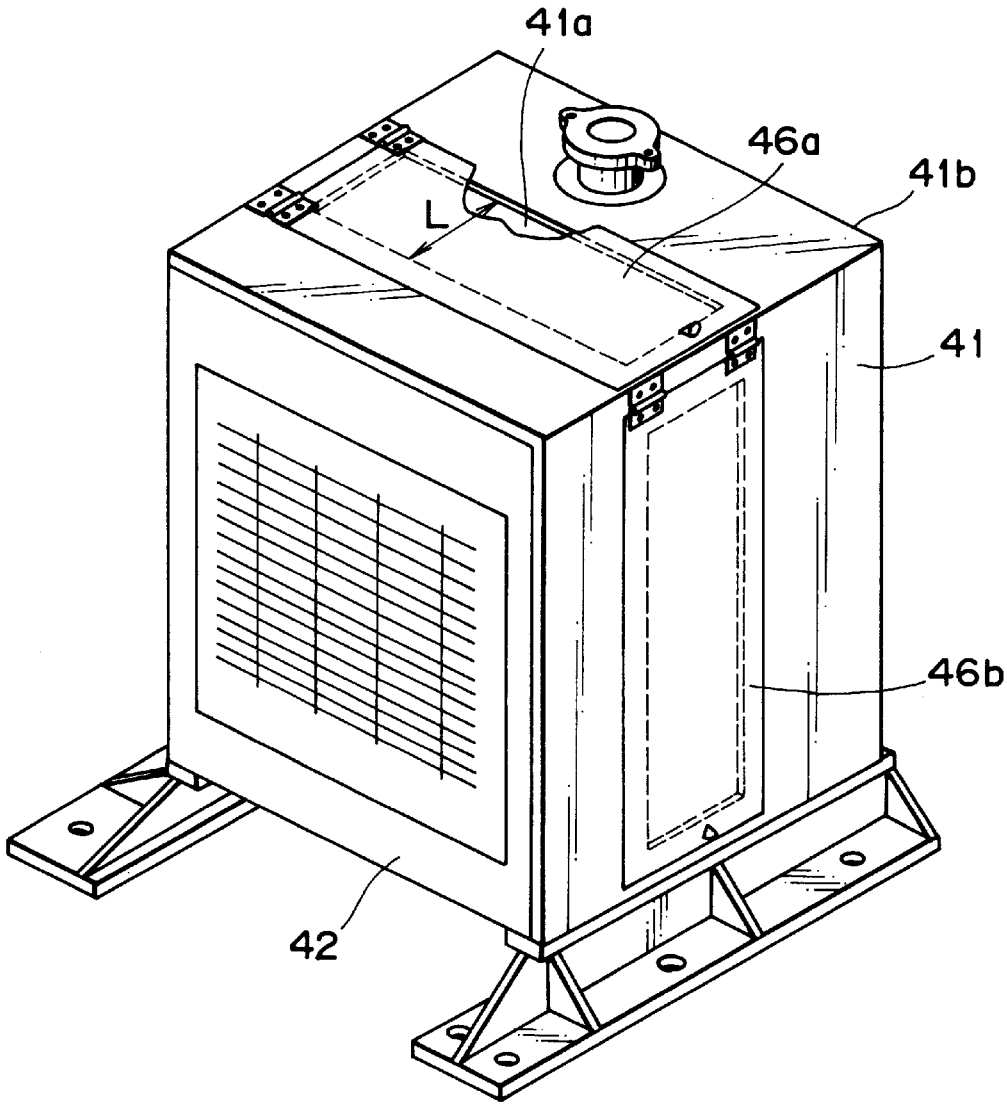
FIG. 11 is a perspective view of a cooling apparatus of a third prior art example.

Generally, the radiator 4 can be extracted by human power of one or two workers. When applied to a large sized construction machine, the radiator 4 may be extracted from the position between the oil cooler 3 and the fan shroud 5, by engaging a lifting hook 23 of a wire 24 of a crane or the like with the hook engagement hole 4*d* in the fixing portion 4*c* of the radiator 4 as shown in FIG. 8 and liking up the radiator 4 by means of the hook 23. Since, at this time, the lower port 4*a* of the radiator 4 has been moved forward from under the fan shroud 5, it meets no obstruction when removed upward. It meets no obstruction also when it is fixed from the above.

The removed radiator 4 can be freely transported to a suitable place for cleaning. Hence, there are no obstacles to the cleaning of the front and rear sides of the radiator 4 and cleaning can be carried out easily and completely.

The radiator 4 gone through the cleaning is moved back following the above described procedure in the reverse sequence, i.e., the radiator 4 is moved over the position between the oil cooler 3 and the fan shroud 5, it is inserted between the oil cooler 3 and the fan shroud 5 from the above, and the fixing portions 4*c* of the radiator 4 are placed on their respective fixing seats 11*f* on the frame members 11L and 11R.

Then, by having the radiator 4 shifted (slid) backward a stroke S, the lower port 4*a* is projected under the fan shroud 5 to be brought close to the cooling water pipe 9*a* for connection with it. At the same time, the upper port 4*b* is also brought close to the cooling water pipe 9*b* so as to be connected with it. Then, by connecting the radiator 4 to the frame members 11L and 11R with bolts 16 and fixing the dust protective net 18 thereto with the thumbscrew bolts 19, the cleaning work of the radiator 4 can be completed.

Since the oil cooler 3, the radiator 4, and the fan shroud 5 are fixed to the pair of the frame members 11L and 11R, it is made possible to fix the oil cooler 3, the radiator 4, and the fan shroud 5 in right positions. Further, since, at the time of fabrication of the construction machine, it is possible to assemble the oil cooler 3, the radiator 4, and the fan shroud 5 into a unit by using the frame members 11L and 11R and then fix the assembly in the upper rotating body 13, the productivity can be improved.

Further, since it is possible to remove and fix the radiator 4 in the vertical direction by utilizing the pair of the left and right frame members 11L and 11R, the apparatus can be applied advantageously to a vehicle whose size is restricted in the lateral direction.

Further, since the radiator 4 can be fixed to the frame members 11L and 11R with the bolts 16 from the above, the work for fastening and unfastening the bolts 16 can be easily performed. The radiator 4 is fixed to the frame members 11L and 11R also at the lower portion with the bolts 14'. Since hands can be inserted obliquely and downwardly from both sides of the radiator 4, the bolts 14' in either position can be easily fastened and unfastened. Especially when the radiator 4 is fixed by the bolt 14' from the side of the fan shroud 5, the work becomes much easier because there is relatively large space on the side of the fan shroud.

As apparent from the above description, since the cooling apparatus for a construction machine according to the invention allows the oil cooler, the radiator, and the fan shroud to be assembled into a unit in advance and the assembly to be fixed in the upper rotating body at the time when the construction machine is fabricated, the productivity is improved. Further, since only the radiator can be easily and quickly extracted from and fixed into its position between the oil cooler and the fan shroud fixed in the upper rotating body, the removed radiator on both its front face and rear face is held free from any obstacle, and hence it can be cleaned easily and completely.

Further, by constructing the apparatus such that the oil cooler and the fan shroud are integrally connected by the frame members which are fixed in the upper rotating body and such that the radiator can be placed into and taken out of the space surrounded by the oil cooler, the fan shroud, and the frame members and detachably fixed to the frame members, it becomes possible to fix the oil cooler, the radiator, and the fan shroud to the frame members in right positions.

Further, in the case of a construction machine having a bonnet above the engine room, since the radiator can be installed and removed in the vertical direction, the apparatus is applied advantageously to a construction machine whose size is limited in the lateral direction (direction of the width).

Further, by arranging the oil cooler and the fan shroud at such a distance that allows the ports for the cooling water supplying and draining pipes to be inserted between them, the radiator together with the ports for the pipes can be taken out and fixed into the position between the oil cooler and the fan shroud.

Further, by having the left and right end portions of the oil cooler and the fan shroud fixed to the pair of the left and right frame members, the oil cooler and the fan shroud can be simply secured to the frame members.

Further, by having the fixing portions of the radiator suspended on the fixing seats on the frame members and detachably fixed to the same with the fixing members, the radiator is prevented from falling down accidentally when the fixing members are removed for taking out the radiator or before the radiator is fixed with the fixing members after it has been mounted because, then, the radiator is suspended on the frame members.

Further, the radiator can be correctly positioned in the vertical direction by means of the fixing seats on the frame members and it can be correctly positioned also in the fore-and-aft direction because it is movable back and forth while it is suspended on the fixing seats. Still further, the radiator can be simply moved back and forth such that the ports for the pipes of the radiator are positioned in the space between the oil cooler and the radiator.

Further, since the radiator can be fixed with the fixing members at its upper portion, setting and removing work of the fixing members can be easily carried out.

Further, by adapting such that the radiator is detachably fixed to the frame members with fixing members from two directions, i.e., from the above and from the front, rear, left, or right, the radiator can be securely fixed to the frame members and also setting and removing work of the fixing members becomes easy.

What is claimed is:

1. A cooling apparatus in a construction machine installed in an upper rotating body comprising:

an oil cooler;

a radiator; and a fan shroud, wherein:

said oil cooler and said fan shroud are directly connected independent of the radiator and securely fixed to the upper rotating body and said radiator is removably fixed to the upper rotating body between and by way of the integrally connected said oil cooler and said fan shroud.

2. A cooling apparatus for a construction machine according to claim 1 further comprising a frame member, wherein:

said oil cooler and said fan shroud are integrally connected by said frame member and said radiator is adapted to be placed into and taken out of a space surrounded by said oil cooler, said fan shroud, and said frame member and detachably fixed to said frame member.

3. A cooling apparatus for a construction machine according to claim 2, wherein a bonnet for opening and shutting is provided above an engine room of the construction machine, said oil cooler and said fan shroud are disposed in the vicinity of the engine, and said radiator is enabled to be placed into and taken out of the space in the vertical direction.

4. A cooling apparatus for a construction machine according to claim 3, wherein said radiator is detachably fixed to said frame member with fixing members from two directions.

5. A cooling apparatus for a construction machine according to claim 2, wherein said frame member is formed of a pair of left and right frame members and said oil cooler and said fan shroud have their left and right side end portions connected to said pair of left and right frame members so as to be fixed thereto.

6. A cooling apparatus for a construction machine according to claim 5, wherein said radiator is detachably fixed to said frame member with fixing members from two directions.

7. A cooling apparatus for a construction machine according to claim 2, further comprising:

a pair of left and right fixing seats provided at an upper portion of said frame members; and a pair of left and right fixing portions provided at upper portions of said radiator, wherein:

said fixing portions are adapted to be suspended on said fixing seats and detachably fixed to the same with fixing members.

8. A cooling apparatus for a construction machine according to claim 7, wherein said radiator is detachably fixed to said frame member with fixing members from two directions.

9. A cooling apparatus for a construction machine according to claim 2, wherein said radiator is detachably fixed to said frame member with fixing members from two directions.

10. A cooling apparatus for a construction machine according to claim 1 further comprising ports projecting from the radiator for connection with cooling water supplying and draining pipes, wherein:

the distance over which said oil cooler and said fan shroud confront is set so as to allow said ports for connection with the cooling water supplying and draining pipes to be inserted between them.

11. A cooling apparatus for a construction machine according to claim 10, wherein said radiator is detachably fixed to said frame member with fixing members from two directions.

* * * * *